US010056661B2

(12) United States Patent
Dandlberger et al.

(10) Patent No.: US 10,056,661 B2
(45) Date of Patent: Aug. 21, 2018

(54) DIFFERENTIAL PHASE SHIFTER ASSEMBLY

(71) Applicant: KATHREIN-WERKE KG, Rosenheim (DE)

(72) Inventors: Stephan Dandlberger, Rosenheim (DE); Georg Tischler, Stephanskirchen (DE)

(73) Assignee: Kathrein-Werke KG, Rosenheim (DE)

( * ) Notice: Subject to any disclaimer, the term of this patent is extended or adjusted under 35 U.S.C. 154(b) by 189 days.

(21) Appl. No.: 15/096,782

(22) Filed: Apr. 12, 2016

(65) Prior Publication Data

US 2016/0301121 A1 Oct. 13, 2016

(30) Foreign Application Priority Data

Apr. 13, 2015 (DE) ..... 10 2015 004 658

(51) Int. Cl.

| | |
|---|---|
| ***H01P 5/12*** | (2006.01) |
| ***H01P 1/18*** | (2006.01) |
| ***H01P 1/06*** | (2006.01) |
| ***H01P 5/02*** | (2006.01) |
| ***H01Q 3/32*** | (2006.01) |

(52) U.S. Cl.

CPC ..... *H01P 1/184* (2013.01); *H01P 1/064* (2013.01); *H01P 5/028* (2013.01); *H01P 5/12* (2013.01); *H01Q 3/32* (2013.01)

(58) Field of Classification Search

CPC ..... H01P 1/184; H01P 1/064; H01P 5/028; H01P 5/12; H01Q 3/32

See application file for complete search history.

(56) References Cited

U.S. PATENT DOCUMENTS

| | | | | |
|---|---|---|---|---|
| 6,850,130 | B1 * | 2/2005 | Gottl | H01P 1/184 333/156 |
| 9,614,281 | B2 * | 4/2017 | Peng | H01Q 3/32 |
| 2004/0246175 | A1 | 12/2004 | Thomas | |
| 2006/0164185 | A1 | 7/2006 | Tae et al. | |
| 2012/0105299 | A1 * | 5/2012 | Goettl | H01Q 1/246 343/853 |
| 2012/0256707 | A1 | 10/2012 | Leiba et al. | |
| 2015/0028968 | A1 | 1/2015 | Katipally et al. | |
| 2016/0049709 | A1 * | 2/2016 | Karikomi | H01Q 1/246 343/850 |
| 2016/0276745 | A1 * | 9/2016 | Fleancu | H01P 5/08 |

FOREIGN PATENT DOCUMENTS

| | | |
|---|---|---|
| DE | 101 04 564 | 9/2002 |
| EP | 1 208 614 | 9/2003 |
| EP | 1 870 959 | 8/2008 |
| JP | 2010-135893 | 6/2010 |
| WO | WO 2014/141993 | 9/2014 |

* cited by examiner

*Primary Examiner* — Robert J Pascal
*Assistant Examiner* — Kimberly Glenn
(74) *Attorney, Agent, or Firm* — Nixon & Vanderhye P.C.

(57) ABSTRACT

Positioned above the actual pointer head of the pointer-shaped feed element, through which the centre axis or swivel axis passes, is an additional capacitor coupling device or coupling disc that is arranged at a distance from said pointer head and is electrically isolated therefrom. This additional coupling device or disc is separated from the electrically conductive pointer head by a disc-shaped insulator which is inserted therebetween.

17 Claims, 5 Drawing Sheets

DIFFERENTIAL PHASE SHIFTER ASSEMBLY

Figure 1:
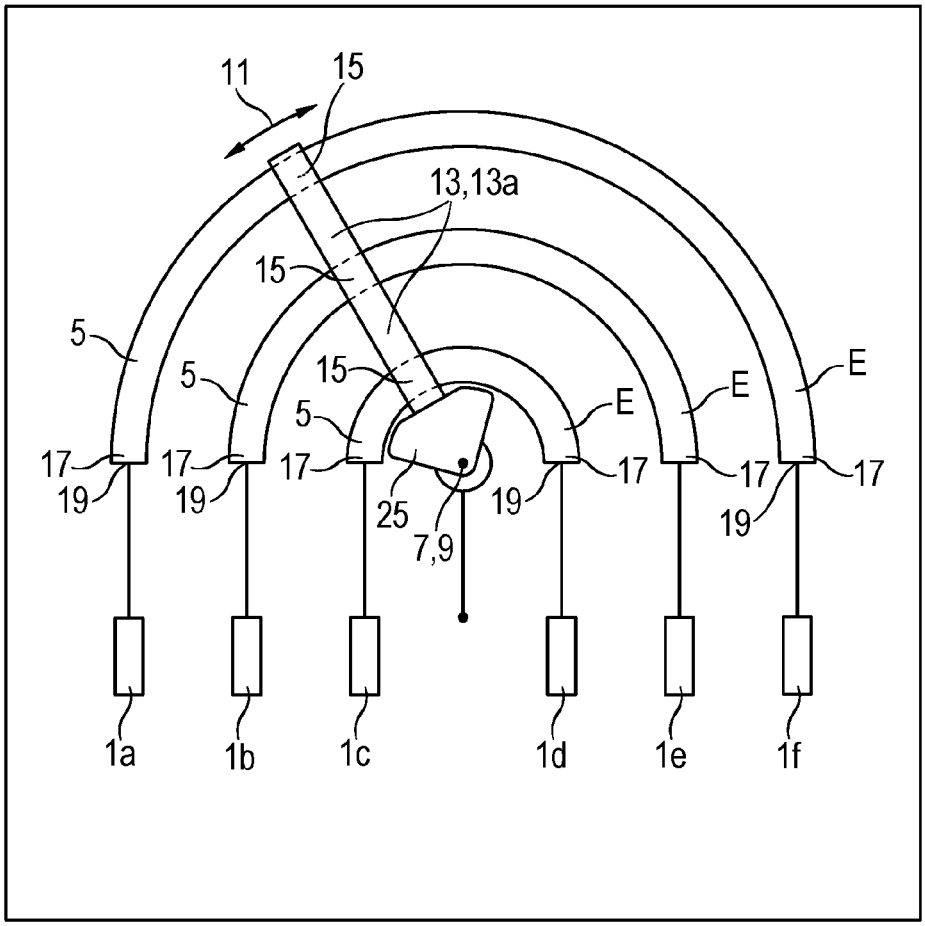

This application claims priority from DE Patent Application No. 10 2015 004 658.6 filed 13 Apr. 2015, the entire contents of which are hereby incorporated by reference.

The invention relates to a differential phase shifter assembly according to the preamble of claim 1.

Mobile radio antennae, in particular those provided for a base station, usually comprise an antenna arrangement having a reflector, a plurality of radiator elements being provided upstream thereof and vertically mutually offset, thus forming an array. Said radiator elements can radiate and receive, for example, in one or two mutually vertical polarisations. In this case, the radiator elements can only be configured in one frequency band for receiving purposes. However, the antenna arrangement can also be configured as a multiband antenna, for example for transmitting and receiving two mutually offset frequency bands. Also known in principle are what are referred to as tri-band antennae.

As is known, the mobile communications network is of a cellular configuration, each cell being allocated a corresponding base station having at least one mobile radio antenna for transmitting and receiving. In this case, the antennae are constructed such that they usually radiate at a specific angle to the horizontal with a downwardly directed main lobe, thereby determining a specific cell size. As is known, this tilt angle is also called a downtilt angle.

A generic differential phase shifter assembly is already known from EP 1 208 614 B1, in which, for a single-column antenna array having a plurality of superimposed radiators, the downtilt angle can be adjusted continuously differently. For this purpose, according to this prior publication, differential phase shifters are used which, when adjusted differently, cause the length of the propagation time and thus the phase shift at the two outputs of a respective phase shifter to be moved in a different direction, as a result of which it is possible to adjust the tilt angle.

In this case, the phase shifter angle can be set and adjusted manually or by means of a remote-controllable retrofit unit, as is known, for example, according to DE 101 04 564 C1.

The generic differential phase shifter assembly comprises at least two concentrically arranged strip line portions. Connection points are provided at the respective opposite ends of these strip line portions, to which points connection lines running to different radiators of an antenna array (in particular of a mobile radio antenna) can be connected.

The phase shifter assembly also has a feed device and/or tapping device (which, in the following, is also sometimes called a feed arm and/or tapping arm or element) that can swivel about a centre axis and/or swivel axis, it being possible in this case for the pointer-shaped feed element to swivel across the plurality of concentric strip lines.

In this case, the pointer-shaped feed arm and/or tapping arm is capacitively coupled to the strip lines, specifically with the interposition of a generally fixed dielectric.

The pointer-shaped feed element is fed capacitively by a central feed line, for which purpose the central feed line (which is connected to an antenna network) has a first coupling surface, connected on the feed line side, in the region of the centre axis or swivel axis. The second coupling surface, which belongs to the feed arm and/or tapping arm or is electrically connected thereto, is provided, offset in the direction of the centre axis or swivel axis, by interposing a dielectric or insulator.

The entire functional construction which has been described is accommodated in two half-shell housing parts which produce the electrical shielding of the differential phase shifter assembly thus formed.

Using a differential phase shifter assembly of this type, it is possible to very efficiently and effectively adjust the individual phases differently with respect to the received signals and/or transmitted signals of, for example, a mobile radio antenna, as a result of which, for example, different tilt angles (downtilt angles) can be adjusted, as is comprehensively described for example in EP 1 208 614 B1.

A differential phase shifter assembly that is substantially comparable in this respect is also known from EP 1 870 959 B1 or also from WO 2014/141993 A1.

Although the generic differential phase shifter assembly has proved very successful, the object of the present invention is to provide an improved differential phase shifter assembly.

An arrangement that is comparable in this respect is also known from JP 2010-135893 A. In this case as well, a first feed line-side coupling device that is electrically connected to the feed line is provided, which device comprises plate-shaped coupling device portions, arranged offset parallel to the centre axis of the central feed line. Arranged therebetween and separated by an insulator is a second coupling device on the tapping arm side, this second device also being disc-shaped and being connected to the arm-shaped or pointer-shaped feed element and/or tapping element.

According to the invention, the object is achieved according to the features stated in claim 1. Advantageous embodiments of the invention are set out in the dependent claims.

The invention provides an even better differential phase shifter assembly using surprisingly simple means.

Particularly if the phase shifter assembly comprises an increasingly greater number of strip lines arranged concentrically to one another, the remaining installation space in the region of the centre axis and/or swivel axis for the pointer-shaped feed element is relatively small. The capacitive feed that has been described, i.e. the capacitive coupling between the first coupling surface on the feed line side and the second coupling surface on the pointer element side has to be accommodated in this small remaining installation space.

In the case of capacitive coupling devices of this type for feeding or decoupling a signal, for a forward wave there is also always a reflecting wave which results in a specific voltage standing wave ratio, which is also abbreviated to VSWR (standing wave ratio).

Various tests have already been carried out to contribute here towards a particular improvement.

In order to achieve a low standing wave ratio and to thereby improve the feed, it is now proposed within the context of the invention to provide an additional capacitively coupled coupling device in the region of the centre axis and/or swivel axis of the feed arm or element and/or tapping arm or element (which is sometimes also called a pointer-shaped feed device and/or tapping device).

In a particularly preferred embodiment, positioned above the actual pointer head of the pointer-shaped feed element, through which the centre axis or swivel axis passes, is an additional coupling device or coupling disc that is arranged at a distance from said pointer head and is electrically isolated therefrom. This additional coupling device or disc is preferably separated from the electrically conductive pointer head by a disc-shaped insulator which is inserted therebetween. For this purpose, it may be sufficient to apply a plastics film to at least one surface or to both mutually facing surfaces of the pointer head or to the adjacent surface of the coupling disc.

Figure 2:
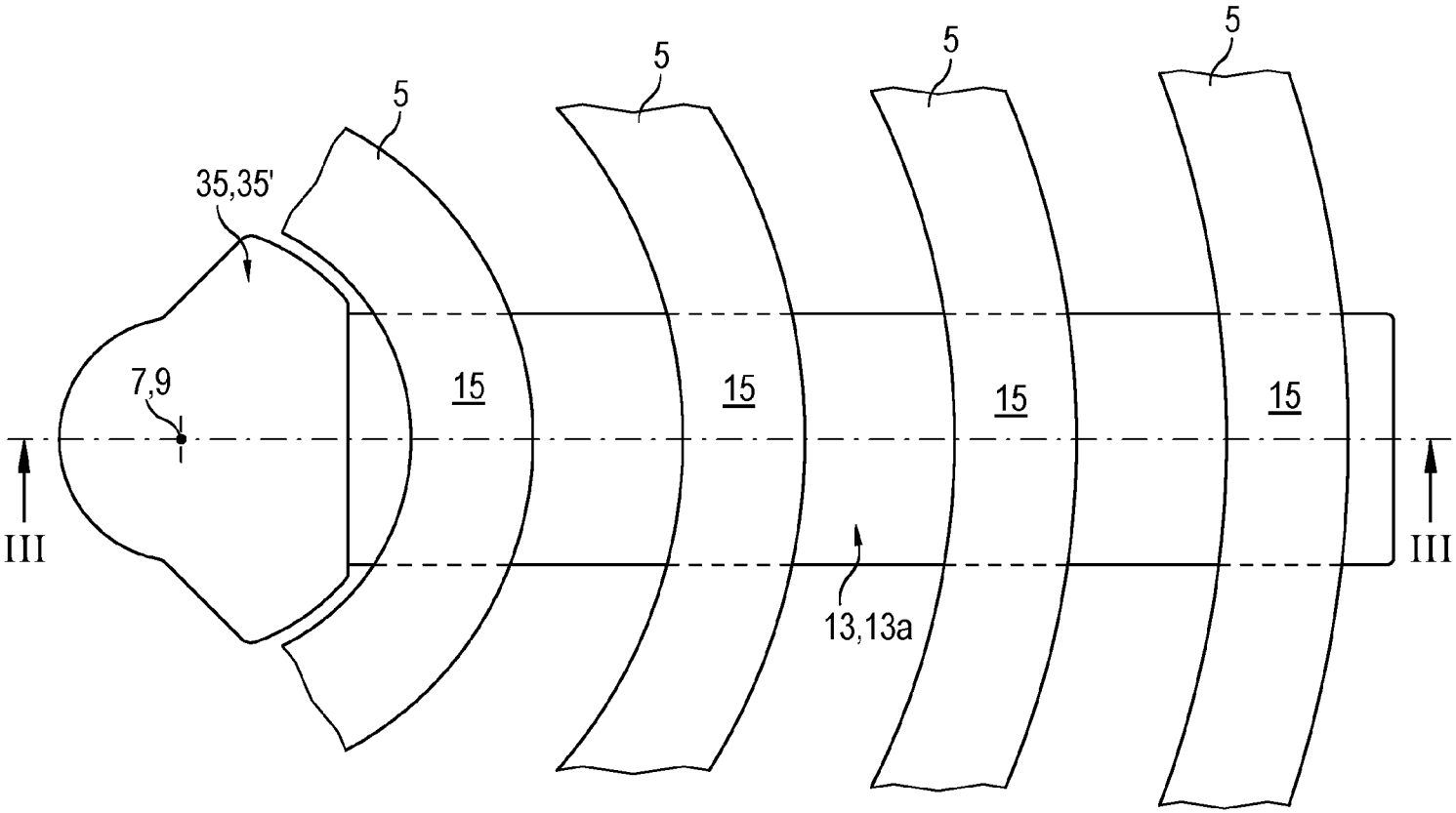
Figure 3:
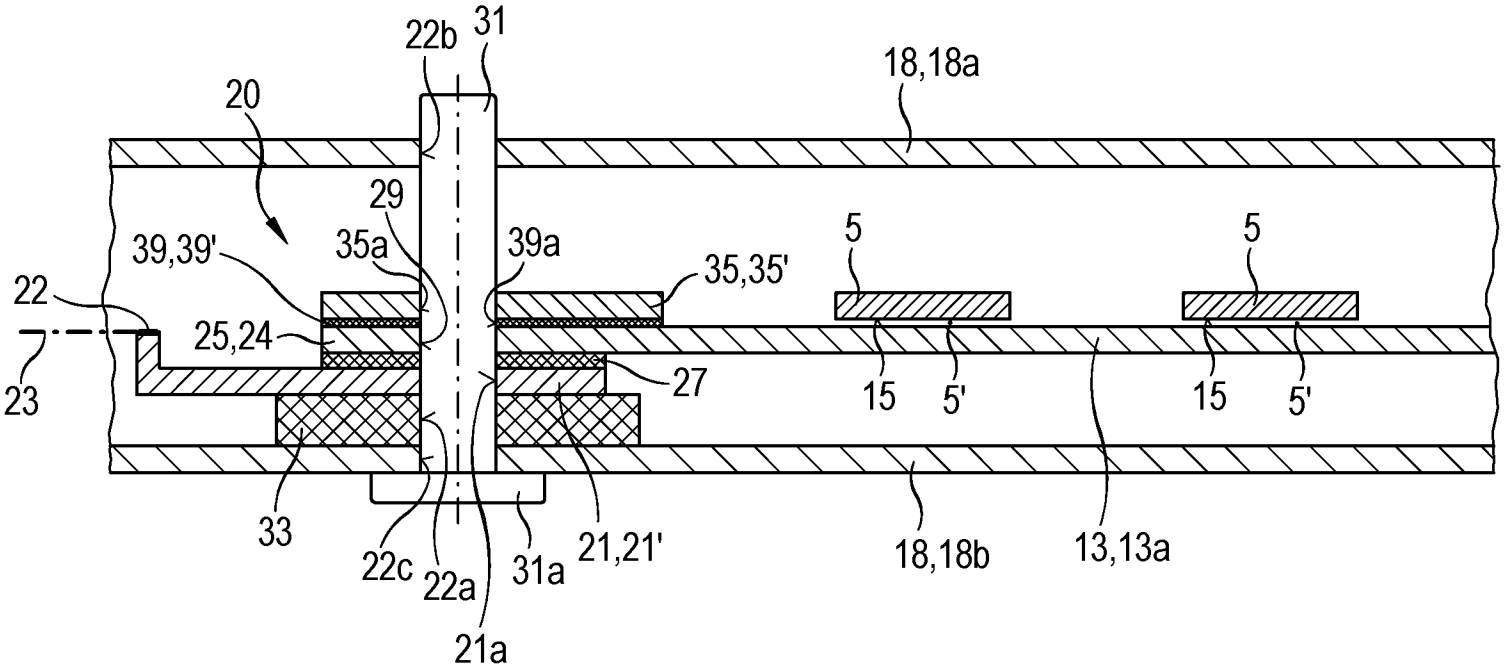
Figure 4:
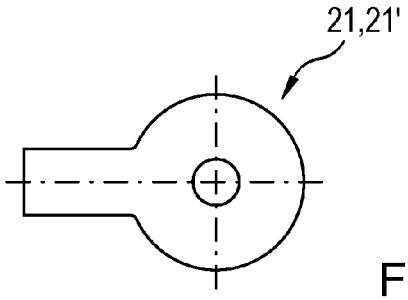
Figure 5:
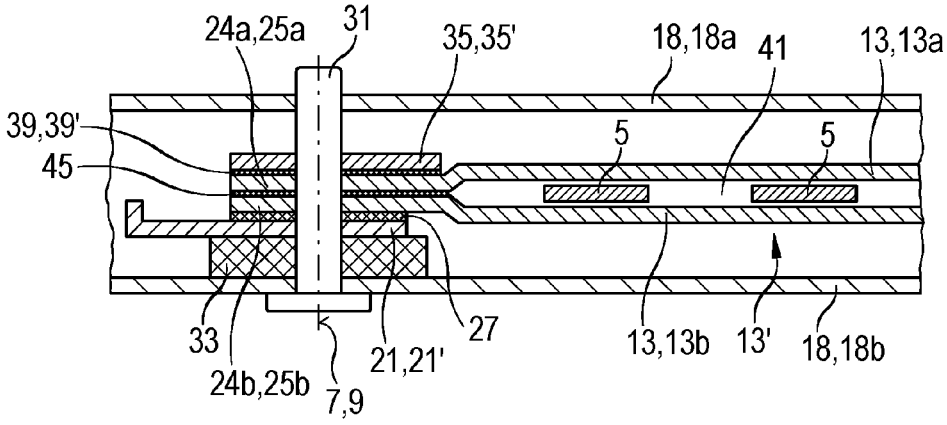
Figure 6:
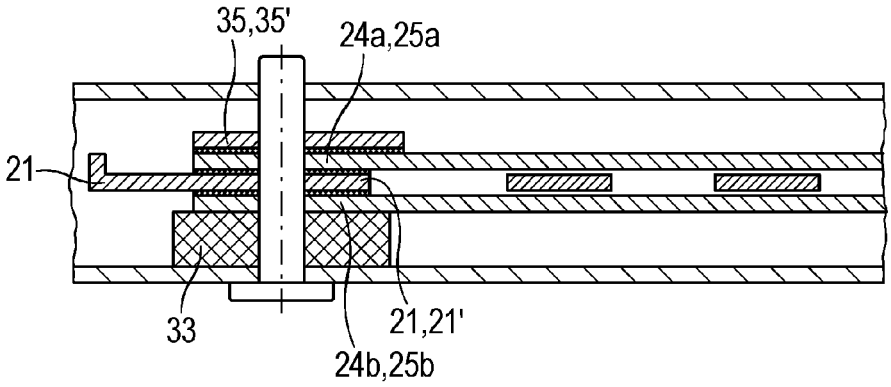
Figure 7:
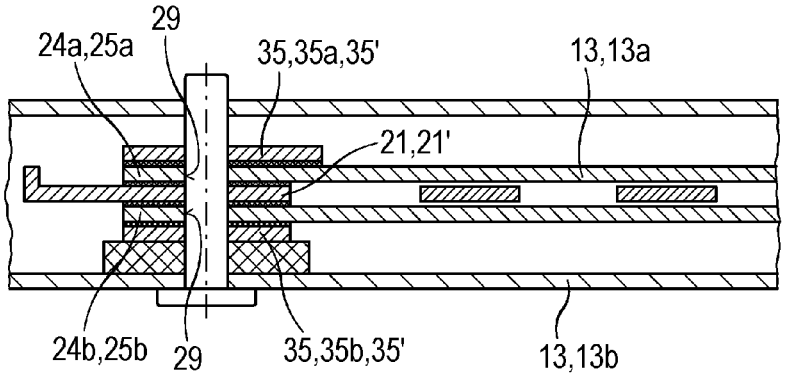
Figure 8:
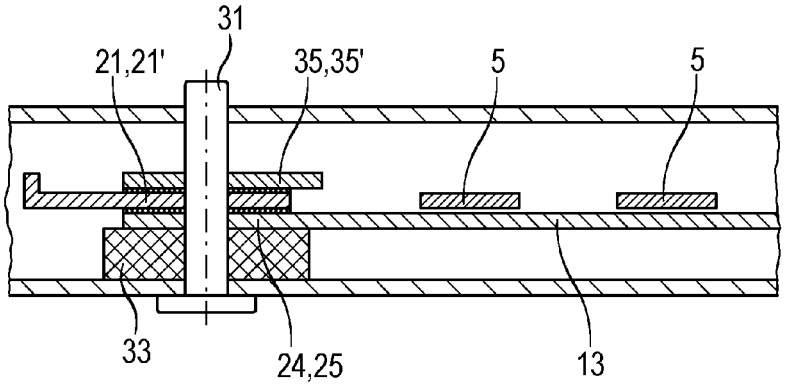

In the following, the invention will be described in more detail with reference to drawings, in which:

FIG. 1: is a schematic plan view of a differential phase shifter assembly according to the invention, the housing cover or half the housing having been removed;

FIG. 2: is an enlarged partial detail view of the feed element or arm and/or tapping element or arm already shown in FIG. 1, and an associated detail of the associated strip lines;

FIG. 3: is a longitudinal cross-sectional view of the feed element and/or tapping element along line III-III in FIG. 2;

FIG. 4: is an enlarged detail view of the coupling device connected to lines on the network side;

FIG. 5: is a longitudinal cross-sectional view of the feed device and/or tapping device that differs from FIG. 3 and which, in this embodiment, unlike FIG. 3, comprises two feed elements and/or tapping elements;

FIG. 6: shows a further modification compared to the embodiment according to FIG. 5, in which the two provided feed elements and/or tapping elements are in a different arrangement in the region of the centre axis and swivel axis, in contrast to the variant according to FIG. 5;

FIG. 7: is a further cross-sectional view of a part similar to the embodiment according to FIG. 5 but in which, unlike the embodiment of FIG. 5, a second further coupling device is provided; and FIG. 8: again shows a different embodiment, similar to the embodiment shown in FIG. 3, the coupling device on the feed line side now being arranged between the coupling portion of the feed device and/or tapping device and the additionally provided coupling device.

FIG. 1 is a schematic plan view of the phase shifter assembly according to the invention, in which the housing cover or half the housing has been removed.

This figure shows that, according to this embodiment, the differential phase shifter assembly comprises three circular-segment-shaped strip lines 5 that are arranged concentrically to a centre 7. In this case, the strip lines 5 are generally arranged in a common plane E. The strip lines do not necessarily have to be semicircular, but rather can also have a circular segment of more than 180°. The strip lines 5 generally have a length by which they only enclose a partial angle of less than 180°.

Extending vertically to the drawing plane E and thus vertically to the plane E in which the strip lines 5 are located is a centre axis or swivel axis 9, about which a lever-shaped, finger-shaped, arm-shaped and/or pointer-shaped feed device and/or tapping device 13 can swivel, according to the double-headed arrow 11.

In the described embodiment, the feed device and/or tapping device 13 mentioned comprises a pointer-shaped or arm-shaped feed element or tapping element 13*a* which, in the following, will sometimes also be called a feed arm and/or tapping arm 13*a*. This feed element and/or tapping element 13*a* is arranged in this case such that it extends from the inner centre axis and/or swivel axis 9 across the strip lines 5 as far as the outermost strip line and in each case covers an underlying strip line coupling portion 5' (FIG. 3) of the respective strip line 5 with a coupling portion 15, the coupling portion 15 of the pointer arm or tapping arm 13 being arranged so as to be rotatable at a distance across the respective strip line 5. This produces a capacitive coupling between the corresponding coupling portion 15 of the pointer arm or tapping arm 13*a* and the portions 5' of the associated strip line 5, which portions are arranged offset with respect to said coupling portion and are covered in a position-dependent manner by the feed arm and/or tapping arm 13*a*.

By appropriately swivelling the pointer-shaped feed arm and/or tapping arm 13*a*, the respective path lengths between a strip line coupling portion 5' of a strip line 5 and the respectively remaining end 17 of the strip line are increased and are reduced with respect to the opposite strip line portion, as a result of which the propagation time of the signals is changed in the opposite direction in a known manner. Consequently, for example, a downtilt angle of connected radiators can be adjusted differently. For this purpose, connection lines 2, which are only indicated in the drawings and lead to the individual radiators 1*a* to 1*f*, are connected to the ends 17 of the strip lines at connection points 19 formed there.

FIG. 2 is an enlarged detail view of the feed device and/or tapping device, specifically comprising the already mentioned feed arm and/or tapping arm that can generally be moved about a centre axis 7 across the strip lines 5 as far as the end 17 of the strip line. In this case, in the embodiments described in the following, four concentric strip lines 5 are provided, of which only portions are shown in the plan view according to FIG. 2, a cross-sectional view along line III-III in FIG. 2 being shown in FIG. 3. In FIG. 3, a part of the housing 18 comprising the two housing halves 18*a* and 18*b* can also be seen in cross-section.

The feed arm and/or the tapping arm 13*a* is fed in the region of the centre axis and swivel axis 9.

For this purpose, as can also be seen in particular from the cross-sectional view according to FIG. 3, a central feed 20 comprising a first coupling device or coupling surface 21 is provided in the region of the centre axis and swivel axis 9, which coupling device or surface is connected to a central feed line 23 by a coupling connection 22 (FIG. 3).

Arranged offset with respect to this first coupling surface 21 (which, in the following, is also called a feed line-side coupling surface or coupling device 21) in the direction of the centre or swivel axis 9 is a pointer head 25 of the feed arm and/or tapping arm 13, usually with the interposition of a dielectric or insulator 27.

The feed line-side coupling surface 21 is preferably configured in this case as a coupling ring 21' (FIG. 4). The pointer head 25 forming the second coupling device or coupling surface 24 on the pointer side or tapping arm side usually also has a centre recess 29, through which a shaft body 31, which forms the swivel axis and supports the pointer arm or tapping arm 13, is provided and which is formed from a plastics material which produces an insulator effect, while preventing an electrical connection.

In this case, the entire arrangement is also generally held and anchored mechanically by a base-forming insulator 33 on the inside 1' of the housing 1, i.e. of the at least one half of the housing 1. In the embodiment shown, the shaft body 31 passes through the entire feed device 20, including a hole 22*c* in the lower part of the housing 18, i.e. in the embodiment shown, in the lower housing half or housing shell 18*b*, the shaft body 31 being provided with a shaft body head 31*a* that has a larger external diameter and rests against the outside of the mentioned housing half 18*b* in the final assembled state, and thus in this case also passes through the mentioned insulator 33 in a hole 22*a* correspondingly formed therein, including a corresponding hole 21*a* in the coupling surface 21 (and through the further parts located therein which will be described in the following). However, the solution can also be reversed such that the shaft body has a greater external diameter than the shaft body head, which can be inserted due to its smaller diameter into a corresponding hole 22*c* in the associated half of the housing until the shaft body having a greater diameter rests on its corresponding stepped shoulder, for example, on the inside of the associated housing shell.

Within the context of the invention, to improve the standing wave ratio (VSWR) in spite of a small available installation space and without employing considerable additional technical measures, it is now provided according to the invention that an additional coupling device 35, preferably in the form of a coupling disc 35' is provided parallel to the pointer head 25. This coupling device is provided offset from the adjoining surface of the pointer head 25 along the centre axis and/or swivel axis 9, in order to produce an additional capacitive coupling between the pointer head 25 and the coupling device 35.

At least one insulation 39, for example in the form of an insulator foil 39' or in the form of an insulator film 39', is provided as the insulator between the uppermost further coupling device 35, preferably in the form of a coupling disc 35', and the pointer head 25 offset therefrom. This separating foil which produces an electrical isolation can also be produced, for example, by an affixed plastics film or by an applied plastics coating.

In the embodiment shown, the mentioned insulation 39 and the coupling device 35 also have a recess or hole 39*a* or 35*a*, through which the shaft body 31 passes (which, moreover, in the embodiment shown, also passes through the second housing half or shell 18*a* through a corresponding hole 22*a* and is held and secured thereby to prevent axial tilting).

The mentioned coupling device 35 can be produced, for example, in the form of the mentioned coupling disc 35', which can be in different sizes, for example in different sizes also with respect to the underlying pointer head 25. In other words, the coupling device 35 can be of a wide range of sizes and shapes in the longitudinal direction and/or in the transverse direction but also with respect to the outer contour that can be seen in plan view. Furthermore, the preferably disc-shaped coupling device 35 can also be realised having different material thicknesses (i.e. having different thicknesses and heights), according to needs and requirements. Finally, it should also be mentioned that the coupling device 35 can be produced, for example from a plurality of discs that are superimposed or consist of or are composed of different disc parts in the circumferential direction. There are no restrictions in this respect.

This simple measure has made it possible to now achieve a significant improvement in the standing wave ratio.

In this case, the invention also makes it possible, with a relatively small available central installation space in the region of the centre axis and swivel axis, i.e. in the region between the centre axis and swivel axis 9 and the innermost strip line 5 that is closest and thus directly adjacent, for the dimensions of the pointer head 25 to be reduced even in the radial direction towards the swivel axis 9, as a result of which the swivel region can even be increased to the left and to the right. In spite of a reduced surface of the pointer head 25 (in the plan view according to FIG. 2), it is possible for a deterioration in the standing wave ratio caused thereby to not only be compensated but overall to even be changed to an improvement by appropriately arranging the mentioned additional further coupling device 35, preferably in the form of the mentioned coupling disc 35'.

The standing wave ratio (VSWR) of the entire phase shifter is thus influenced by the additional coupling device 35, preferably in the form of the coupling disc 35', which consists of metal (i.e. is generally electrically conductive) or is at least provided with a metallic outer layer. This results not only in a general improvement in the standing wave ratio, but it also makes it possible for the standing wave ratio (VSWR) to be optimised and/or adjusted.

The present invention also makes it possible, even when a pointer head 25 is produced having the maximally greatest outer contour which, in the region of the rotational axis of the phase shifter, of the pointer arm or tapping arm and the innermost and thus smallest strip line arc, to achieve a further improvement in the standing wave ratio (VSWR) by up to 20% (and sometimes even more) due to the described invention.

In contrast to the embodiment which is shown in particular in the cross-sectional view according to FIG. 3, the mentioned and described feed arm and/or tapping arm 13 can also be formed in a different way, in which case the advantages according to the invention can always be achieved when the additionally provided third coupling device 35 is used.

In the variant according to FIG. 5, which is a different cross-sectional view to that of FIG. 3, the feed device and/or tapping device 13 is now configured as a pair of feed arms and/or tapping arms 13'. In this case, the feed device and/or tapping device is designed such that the pointer-shaped feed device or tapping device 13 is formed virtually in the shape of a fork starting from the centre axis or swivel axis 9, so that a first feed arm and/or tapping arm 13*a* on one side extends over all the strip lines 5 as far as its radially outer end, and a second feed arm and/or tapping arm 13*b* on the opposite side is guided over all the strip lines 5 as far as an outer end. As a result, all the strip lines 5 are positioned as it were in a fork-shaped or pocket-shaped mount 41 between the two mutually parallel feed elements and/or tapping elements 13*a* and 13*b*, from which the strip lines 5 are electrically isolated, optionally with the insertion therebetween of solid insulation layers (dielectrics).

In this case, it is provided in the embodiment shown according to FIG. 5 that, for example, each of the two feed arms or tapping arms 13*a*, 13*b* forming the pair of feed arms or tapping arms 13' is provided with a common or electrically isolated second coupling device 24*a*, 24*b*, one coupling device 24*a* being electrically connected to the first feed arm and/or tapping arm 13*a* and the further coupling device 24*b* (which also belongs to the second coupling device) being electrically connected to the further feed arm and/or tapping arm 13*b*. Thus, the mentioned two second coupling devices 24*a*, 24*b* each form respective pointer heads 25*a*, 25*b* for the two feed arms and/or tapping arms 13*a*, 13*b*.

In this case, the two coupling devices 24*a*, 24*b* that form a pair and are on the feed arm side and/or tapping arm side can be in galvanic contact with one another or can be coupled together capacitively, specifically with the interposition of an insulator 45 or a thin insulator layer 45, a film layer 45, etc. The basic construction is not changed thereby compared to the previous embodiments.

FIG. 6 merely shows, in contrast to FIG. 5, that the two coupling devices 24*a*, 24*b* on the feed arm side and/or tapping arm side can be arranged on the two opposite sides of the first or feed line-side coupling device 21. In other words, one of the two feed arms and/or tapping arms 13*a* is arranged having its associated coupling device 24*b* between the first feed line-side coupling device 21 and an insulating base (insulator 33) which is generally provided in a manner fixed to the housing and which produces an electrical isolation from the housing 18, 18*b*.

In this case as well, an insulator or an insulation layer 27*a*, etc. is provided between the second coupling device 24*a*, for example in the form of the pointer head 25*a*, and the adjacent and parallel first or feed line-side coupling device 21, in order to allow capacitive coupling while preventing electrical contacting. Likewise, an insulation layer or an insulator, for example in the form of a film 27*b*, etc., producing an electrical isolation, is also provided between the mentioned first or feed line-side coupling device 21 and the outer second coupling device 24*b*, for example in the form of the pointer head 25*b*, which is generally part of the second feed element and/or tapping element 13*b*.

In this variant as well, the advantages according to the invention can be achieved by realising the mentioned third coupling device 35, 35'.

FIG. 7 supplements the embodiment according to FIG. 6 and shows that, in this case, not only the coupling device 35 described on the basis of the previous embodiments and also provided with reference numeral 35*a* in FIG. 7, for example in the form of the coupling disc 35', but also the second further coupling device 35*b* is provided as the further or third coupling device 35.

Thus, in this variant as well, the construction is such that respective second or feed arm-side and/or tapping arm-side coupling devices 24*a* and 24*b* are arranged on both sides next to the first or feed line-side coupling device 21, next to which second coupling devices and further outwards respective coupling devices 35*a* and 35*b* provided according to the invention are positioned.

Differing from the variant according to FIG. 7, it would also be possible that, for example, only the lower coupling device 35 in FIG. 7, provided according to the invention, for example in the form of the coupling disc 35*b*, can be provided so that conversely it is possible to dispense with the upper further coupling device 35 shown in FIG. 7, for example in the form of the coupling disc 35*a* provided there. This is then an embodiment that is more or less identical to that of FIG. 3, but just in an orientation rotated by 180°. There is no difference in terms of function.

Finally, a variant according to FIG. 8 will also be described, which differs from the embodiment according to FIG. 3 in that the third or further coupling device 35 provided according to the invention is not arranged next to the second coupling device 24*a* of a feed device and/or tapping device 13, but rather on the side of the first or feed line-side coupling device 21 opposite the first or feed line-side coupling device 21. Thus, the first or feed line-side coupling device 21 is positioned between the corresponding coupling device of the feed device and/or tapping device 13 and the coupling device 35 that is provided according to the invention and is preferably in the form of a coupling disc 35'. The advantages according to the invention can also be achieved thereby.

The invention claimed is:

1. A differential phase shifter assembly comprising:

a plurality of strip lines arranged concentrically to one another and at the opposite strip line ends of which connection points for connection lines leading to radiators are provided, an arm-shaped or pointer-shaped feed device and/or tapping device that can be swivelled about a center axis and/or swivel axis and, in so doing, is moveable across the plurality of strip lines, a central feed which comprises a first or feed line-side coupling device which can be connected to a central feed line, and a second or feed arm-side and/or tapping arm-side coupling device which is electrically isolated from said first coupling device and is offset in the direction of the center axis or swivel axis, which second coupling device is electrically connected to the feed device and/or tapping device or is part of the feed device and/or tapping device, and at least one further capacitive coupling device provided in the region of the center axis and/or swivel axis, the at least one further coupling device being arranged a) next to the second coupling device so that the second coupling device is positioned between the first coupling device and the at least one further capacitive coupling device, and/or b) next to the first coupling device so that first coupling device is positioned between the second coupling device and the at least one further capacitive coupling device.

2. The differential phase shifter assembly according to claim 1, wherein the feed device and/or tapping device has a plate-shaped pointer head in the region of the center axis and/or swivel axis, which pointer head forms the second coupling device or is part of the second coupling device.

3. The differential phase shifter assembly according to claim 1, wherein the further capacitive coupling device consists of a coupling disc or comprises said coupling disc.

4. The differential phase shifter assembly according to claim 1, further comprising an insulator, in the form of a disc, a film or a foil, provided between the second and the further capacitive coupling device.

5. The differential phase shifter assembly according to claim 1, wherein a further or third coupling device is arranged such that it cannot rotate relative to the feed device and/or tapping device or such that it is rotationally engaged and can be swivelled together with the feed device and/or tapping device.

6. The differential phase shifter assembly according to claim 1, wherein the first coupling device consists of a coupling ring or comprises a coupling ring.

7. The differential phase shifter assembly according to claim 1, wherein the second coupling device, in the form of a plate-shaped or disc-shaped pointer head, comprises a central recess.

8. The differential phase shifter assembly according to claim 1, wherein the further coupling device, in the form of a coupling disc, comprises a central recess.

9. The differential phase shifter assembly according to claim 1, further comprising a shaft body, which consists of an insulator material or is covered by an insulation layer, provided in the region of the center axis and/or swivel axis, which shaft body passes through a central recess in a pointer head of the feed device and/or tapping device and also passes through the central recess in a further coupling device, in the form of the coupling disc.

10. The differential phase shifter assembly according to claim 1, wherein the second and the further coupling devices overlap or cover one another by at least by 50%, in a plan view parallel to the center axis and/or swivel axis.

11. The differential phase shifter assembly according to claim 1, wherein the feed device and/or tapping device consists of a feed element and/or tapping element or comprises said element, which extends on one side of the strip lines.

12. The differential phase shifter assembly according to claim 1, wherein the feed device and/or tapping device consists of two feed elements and/or tapping elements or comprises elements, which are arranged offset in the direction of the center axis and/or swivel axis so that feed lines pass through between the two spaced-apart feed elements and/or tapping elements and are capacitively coupled to the feed lines.

13. The differential phase shifter assembly according to claim 12, wherein each of two feed elements and/or tapping elements or arms is provided in the region of the center axis and/or swivel axis with its own pointer head, which heads are electrically connected or are coupled capacitively.

14. The differential phase shifter assembly according to claim 13, wherein the two pointer heads are arranged between the first coupling device and the further coupling device.

15. The differential phase shifter assembly according to claim 13, wherein the pointer head that is connected to one of the two feed elements and/or tapping elements is arranged between the first coupling device and the further coupling device and the other pointer head, which is connected to the further feed arm and/or tapping arm, is arranged on the side of the first or feed line-side coupling device opposite the first pointer head.

16. The differential phase shifter assembly according to claim 15, wherein respective further coupling devices, each in the form of a coupling disc, are provided on the two sides, respectively directed away from each other, of the two feed elements and/or tapping elements.

17. A differential phase shifter assembly comprising:

a plurality of strip lines arranged concentrically to one another;

connection points provided at opposite strip line ends, the connection points being configured for connection to lines leading to radiators;

a feed and/or tapping device structured to be moveable across the plurality of strip lines by swivelling about an axis;

a central feed comprising:

a first coupler configured to be connected to a central feed line, and a second coupler configured to be electrically isolated from said first coupler and offset in the direction of the axis, the second coupler electrically connected to the feed and/or tapping device or being part of the feed and/or tapping device, and at least one further, capacitive coupler provided in the region of the axis, the at least one further capacitive coupler being disposed:

a) next to the second coupler so that the second coupler is positioned between the first coupler and the at least one further, capacitive coupler, and/or b) next to the first coupler so that the first coupler is positioned between second coupler and the at least one further, capacitive coupler.

* * * * *